US009073071B2

(12) United States Patent
Tsai

(10) Patent No.: US 9,073,071 B2
(45) Date of Patent: Jul. 7, 2015

(54) HORSESHOE-SHAPED SHOWER OUTLET ASSEMBLY

(71) Applicant: AGREAT SHOWER & SANITARY (XIAMEN) CO., LTD., Xiamen (CN)

(72) Inventor: Pi-Kuang Tsai, Taichung (TW)

(73) Assignee: AGREAT SHOWER & SANITARY (XIAMEN) CO., LTD., Xiamen (CN)

( * ) Notice: Subject to any disclaimer, the term of this patent is extended or adjusted under 35 U.S.C. 154(b) by 218 days.

(21) Appl. No.: 13/749,684

(22) Filed: Jan. 25, 2013

(65) Prior Publication Data

US 2014/0209708 A1 Jul. 31, 2014

(51) Int. Cl.
*B05B 1/18* (2006.01)
*B05B 1/16* (2006.01)

(52) U.S. Cl.
CPC ..... *B05B 1/18* (2013.01); *B05B 1/1636* (2013.01); *B05B 1/1645* (2013.01); *B05B 1/1627* (2013.01)

(58) Field of Classification Search
CPC ..... B05B 1/18; B05B 1/30; B05B 1/185; B05B 1/1645; B05B 1/1636; B05B 1/1627; B05B 1/3026; A61H 33/6012; A61H 33/6052; A61H 33/6063
USPC ..... 239/581.1, 548, 587.5, 587.6, 579, 239/436–438, 443–447, 393, 397, 538–540, 239/552–553.5, 556–568
See application file for complete search history.

(56) References Cited

U.S. PATENT DOCUMENTS

| | | | | |
|---|---|---|---|---|
| 8,708,255 | B2 * | 4/2014 | Steffens | 239/579 |
| 2006/0131445 | A1 * | 6/2006 | Petrovic et al. | 239/443 |
| 2008/0250556 | A1 * | 10/2008 | Mang et al. | 4/601 |
| 2009/0276953 | A1 * | 11/2009 | Hsu et al. | 4/601 |
| 2011/0114752 | A1 * | 5/2011 | Li et al. | 239/222.11 |
| 2011/0133003 | A1 * | 6/2011 | Lu et al. | 239/587.5 |
| 2012/0031511 | A1 * | 2/2012 | Farley | 137/544 |
| 2012/0145810 | A1 * | 6/2012 | Zhou et al. | 239/443 |

* cited by examiner

*Primary Examiner* — Len Tran
*Assistant Examiner* — Cody Lieuwen
(74) *Attorney, Agent, or Firm* — Chun-Ming Shih

(57) ABSTRACT

A horseshoe-shaped shower outlet assembly includes a main outlet body, a positioning valve, an adapter member, a changeover valve, two interlinking valves and a horseshoe-shaped shower head. The main outlet body in which there is a changeover space developed includes an inlet, a first outlet, a second outlet and a third positioning port; the positioning valve has one end securely connected to the third positioning port; the adapter member has one end coupled with the second outlet; the changeover valve is pivoted to and held in both the positioning valve and the third positioning port; the interlinking valves are situated at external ends of the positioning valve and the adapter member wherein one of the interlinking valves is actuated with the changeover valve synchronously; turned between predetermined angles under effect of external force, and taken as an interface by which a user can switch and control water flows.

7 Claims, 6 Drawing Sheets

HORSESHOE-SHAPED SHOWER OUTLET ASSEMBLY

BACKGROUND OF THE INVENTION

1. Field of the Invention

The present invention relates to a shower outlet assembly, particularly a horseshoe-shaped shower outlet assembly.

2. Description of the Prior Art

In general, a shower head installed in a shower room is accompanied by two outlets and one faucet (a selector switch) wherein one of the outlets supplies shower water downward, the other is connected to a shower nozzle hose for water downward sprayed on a user, and the faucet is switched to different positions for various water flows or termination of water supply.

This type of shower head based on the prior art, however, consists of not only complicated internal components but also excessive external accessories (e.g., shower nozzle and hose thereof), resulting in trivial indirect operation.

Accordingly, it has been a critical issue for persons skilled in the art to design a shower outlet assembly which features simplified components, minimized accessories, easy operation and aesthetics.

SUMMARY OF THE INVENTION

The object of the present invention is to provide a horseshoe-shaped shower outlet assembly which has simplified components, reducing manufacture costs, linking minimized accessories, facilitating assembly and conforming to aesthetic demands.

The other object of the present invention is to provide a horseshoe-shaped shower outlet assembly with a user-friendly interface for easy operation.

To realize the above purposes, the present invention of a horseshoe-shaped shower outlet assembly comprises:

A main outlet body in which there is a changeover space developed, comprising an inlet, a first outlet, a second outlet and a third positioning port, each of which is connected between the changeover space and the outside;

A positioning valve with one end securely connected to the main outlet body's third positioning port;

An adapter member which allows one end to be securely connected to the main outlet body's second outlet and comprises a number of discharge orifices;

A changeover valve pivoted to and held in both the positioning valve and the third positioning port;

Two interlinking valves connected to external ends of the positioning valve and the adapter member and sealing both the second outlet and the third positioning port on the main outlet body wherein one of the interlinking valves is synchronously actuated with the changeover valve;

A horseshoe-shaped shower head which comprises a number of shower outlets and is coupled with the two interlinking valves, turned within specific angles under effect of external force, and taken as an interface by which a user switch and control water flows.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
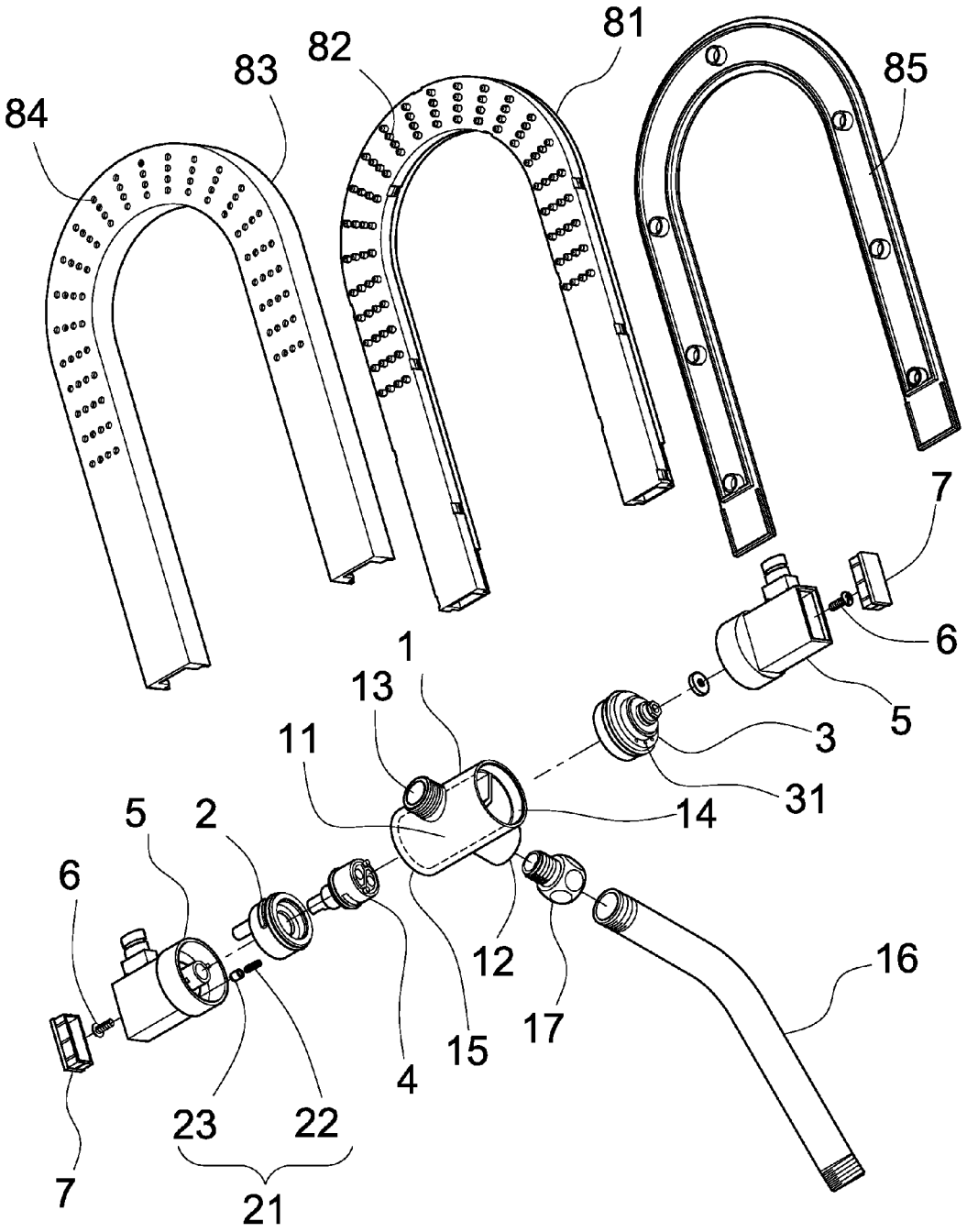
FIG. 1 is a perspective exploded view of the present invention in which all components are described.
Figure 2:
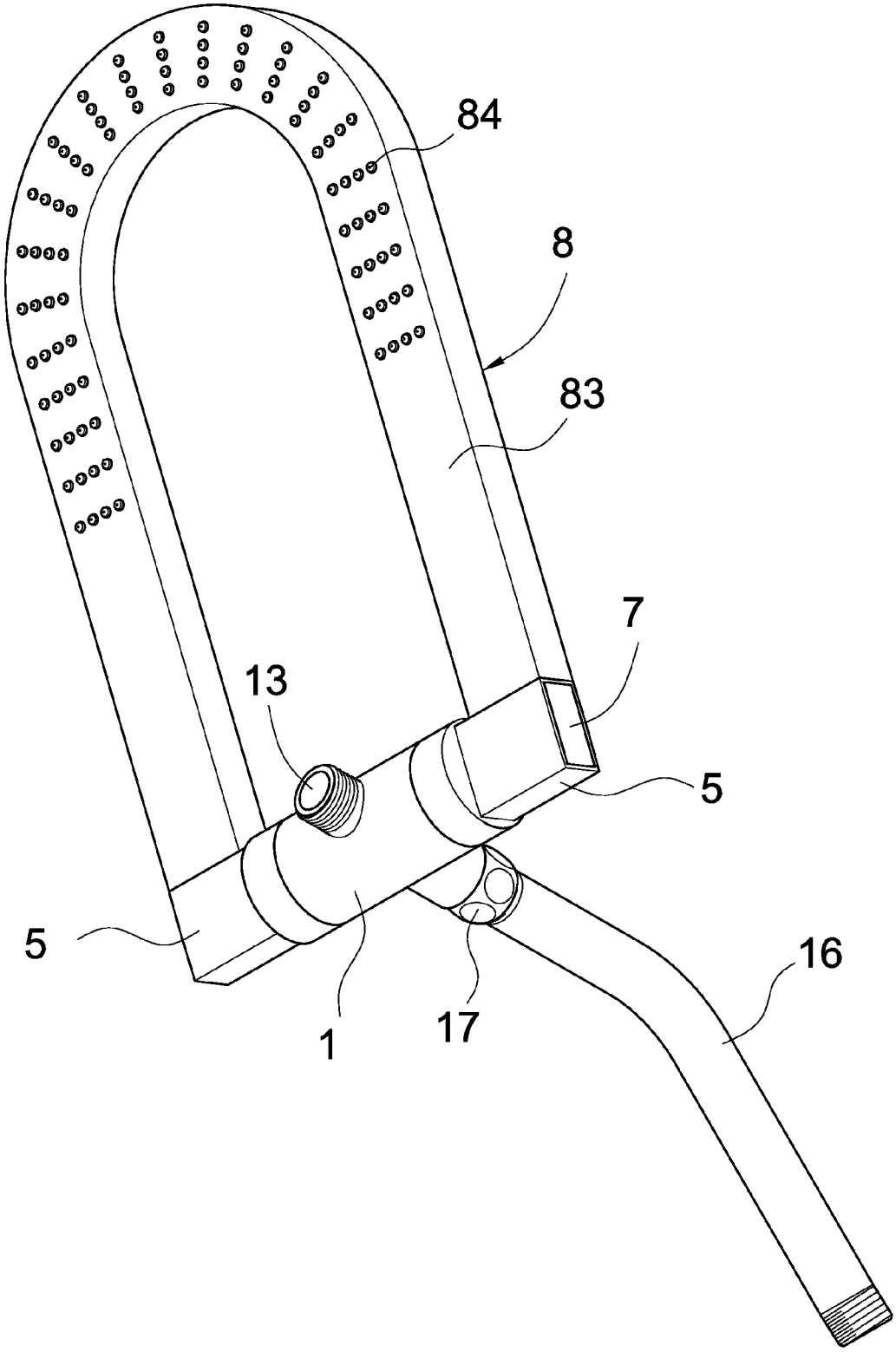
FIG. 2 is a perspective view of the present invention which has been assembled.
Figure 3:
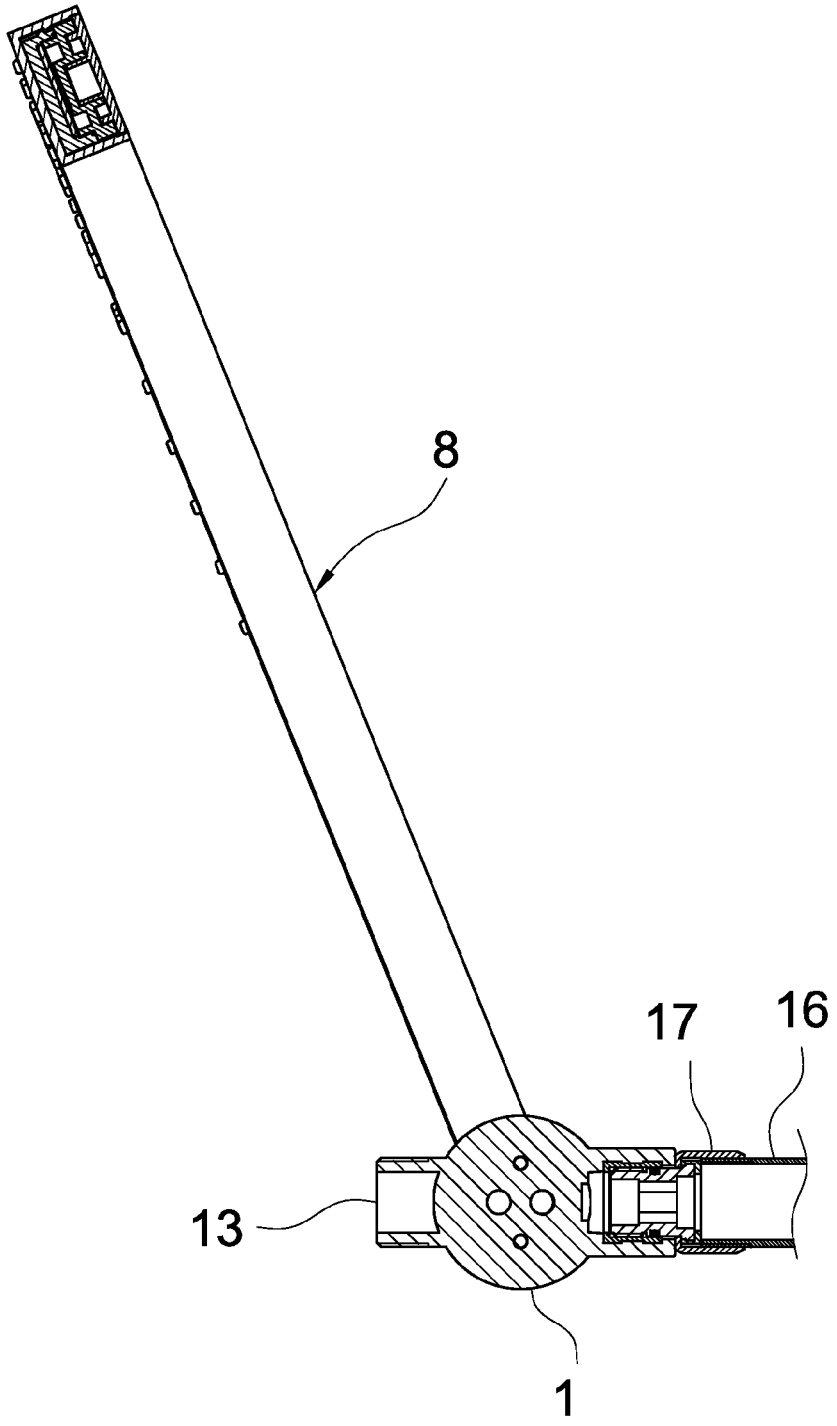
FIG. 3 is a sectional view of the present invention in which the positions of relevant components inside a main outlet body are described.
Figure 4:
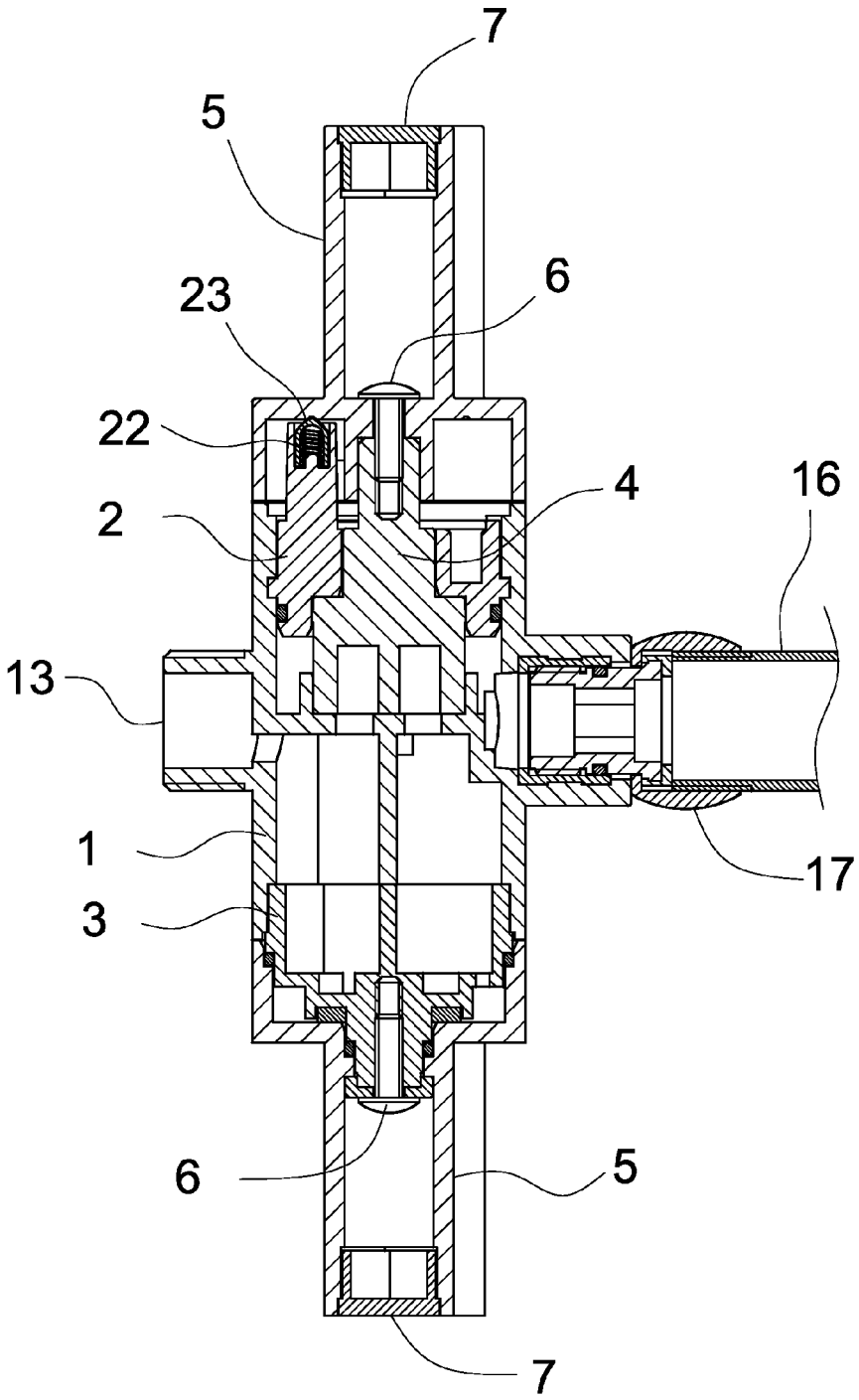
FIG. 4 is a partial sectional view of the present invention in which the positions of relevant components and channels are described.

Referring to FIG. 1 through FIG. 4 which illustrate the present invention of a horseshoe-shaped shower outlet assembly comprises: a main outlet body 1, a positioning valve 2, an adapter member 3, a changeover valve 4, two interlinking valves 5, two bolt-on members 6, two caps 7 and a horseshoe-shaped shower head 8.

The main outlet body 1 is a cross pipe in which a changeover space 11 is developed and is externally provided with an inlet 12, a first outlet 13, a second outlet 14 and a third positioning port 15, each of which is connected between the changeover space 11 and outside; the inlet 12 develops female threads used to link an external hose 16 or an adapter 17 thereof; the first outlet 13 develops male threads used to externally link another type of outlet accessory.

The positioning valve 2 has two ends, one connected to the third positioning port 15 (which is not an outlet port) of the main outlet body 1 and the other connected to a flexible positioning module 21 which comprises (a) a spring 22 resisting the outside of the positioning valve 2 and (b) a positioning column 23 contacting the spring 22.

The adapter member 3 has one end securely connected to the second outlet 14 on the main outlet body 1 and comprises a number of discharge orifices 31.

The changeover valve 4 is pivoted to and held in both the positioning valve 2 and the third positioning port 15 and fixed on the interlinking valve 5.

The two interlinking valves 5, which are installed at external ends of the positioning valve 2 and the adapter member 3, are able to seal the second outlet 14 and the third positioning port 15 on the main outlet body 1 wherein one of the interlinking valves 5 externally connected to the positioning valve 2 is designed to have a locating slot 51 so that the positioning column 23 of the flexible positioning module 21 held in the positioning valve 2 slips in and is glided and positioned by the locating slot 51.

One of the two bolt-on members 6 (a screw in general) can be externally screwed into the interlinking valve 5 and coupled with the changeover valve 4 (or the adapter member 3) so that the interlinking valve 5 which is situated outside the second outlet 14 (or the third positioning port 15) on the main outlet body 1 revolves under effect of force, actuating the changeover valve 4 to turn synchronously.

The two caps 7 externally seal the interlinking valves 5 to conceal the bolt-on members 6.

The horseshoe-shaped shower head 8 is provided with a horseshoe-shaped body 81, a horseshoe-shaped front cover 83 and a horseshoe-shaped rear cover 85: the horseshoe-shaped body 81 comprises (a) a horseshoe-shaped water channel with its both ends connecting external environment and (b) a number of shower outlets 82 at its front side and allows its both ends to be coupled with the interlinking valves 5; the horseshoe-shaped front cover 83 which is covered on the front side of the horseshoe-shaped body 81 comprises a number of front cover outlets 84 connected to the shower outlets 82; the horseshoe-shaped rear cover 85 is covered on the back side of the horseshoe-shaped body 81.

Figure 5:
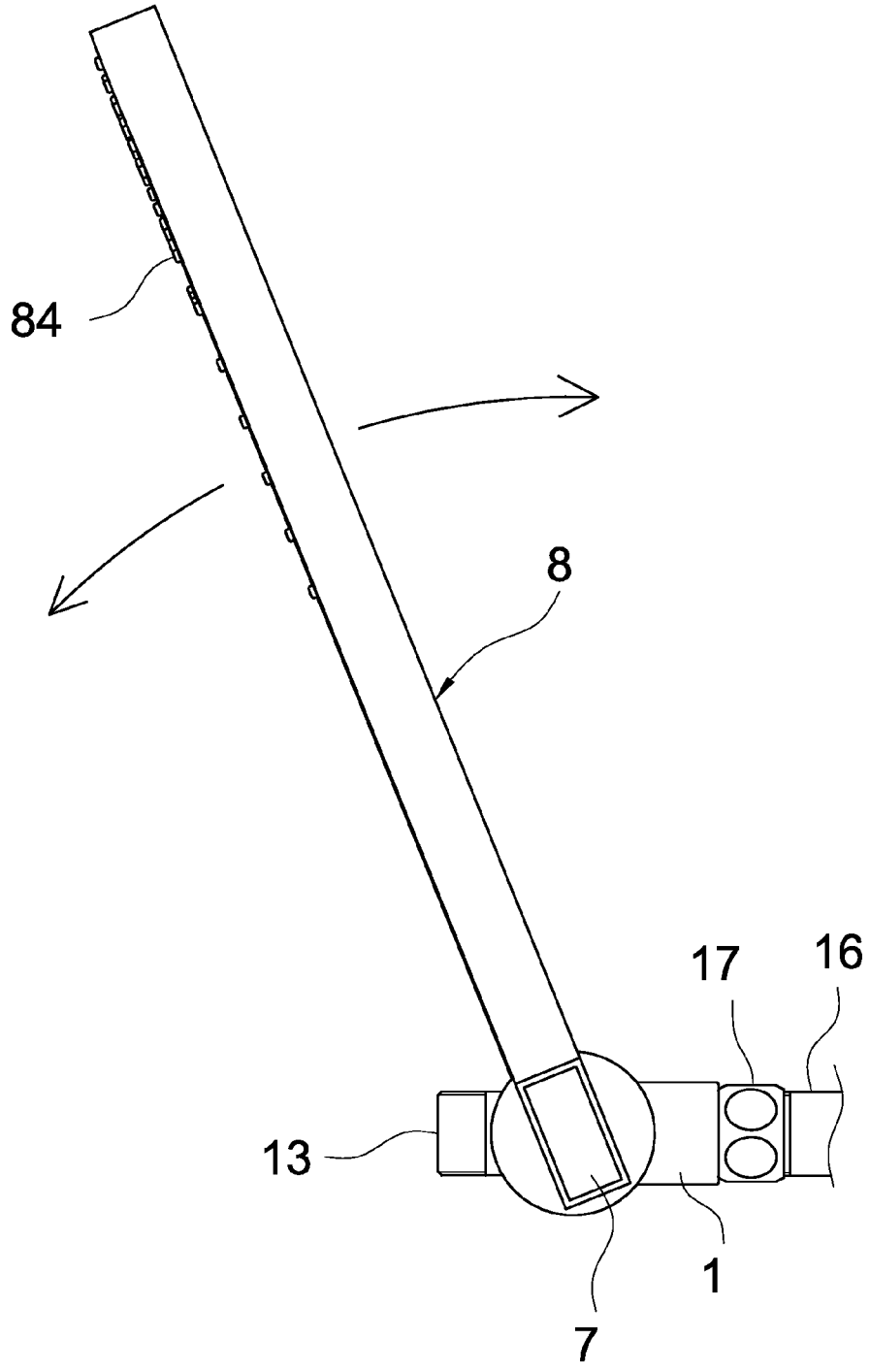
FIG. 5 is a schematic view of the present invention in which a horseshoe-shaped shower head used in turning on or off water supply is described.
Figure 6:
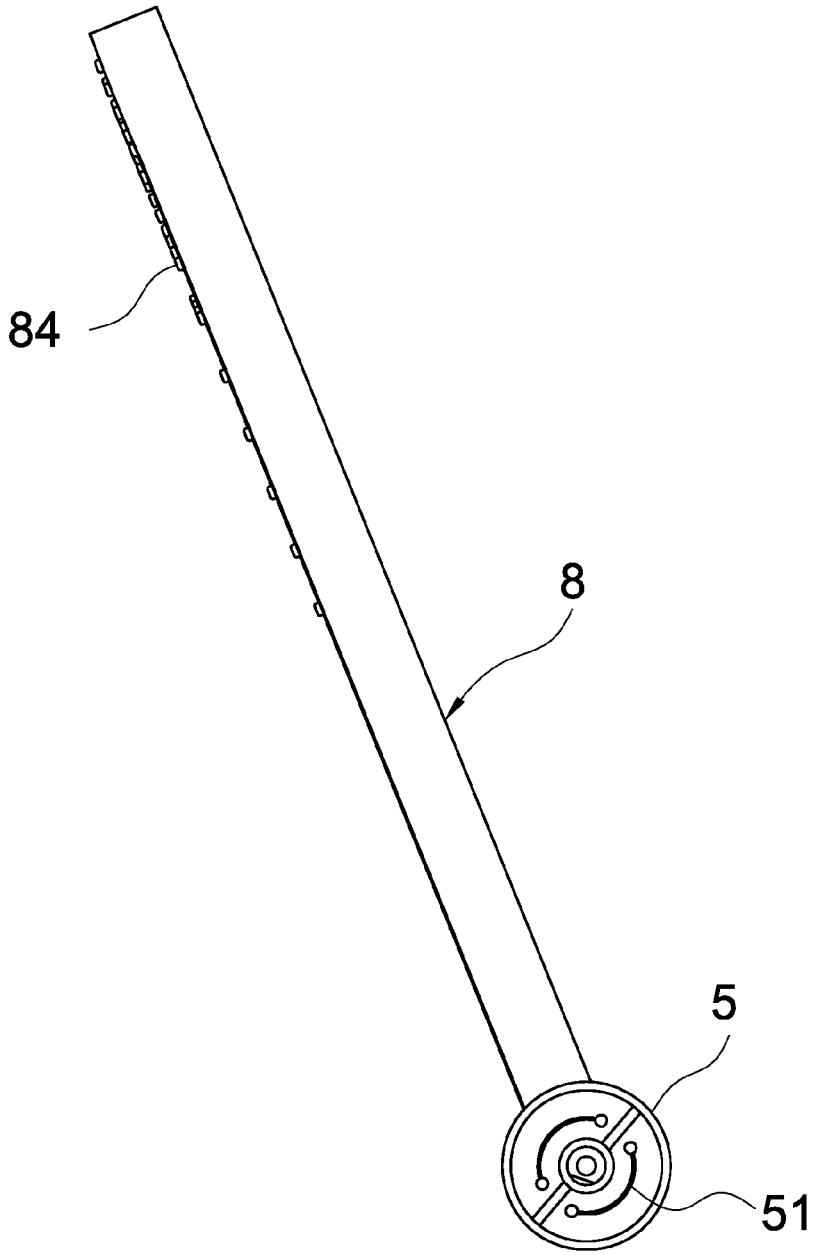
FIG. 6 is a sectional view of the present invention in which both the horseshoe-shaped shower head synchronously rotating the two interlinking valves at a predetermined angle and a positioning valve's flexible positioning module positioned in a locating slot are described.

In addition to main components in the present invention of a horseshoe-shaped shower outlet assembly and assembling methods thereof, the features for use of the present invention are further introduced in FIGS. 5 and 6:

In the present invention, a user who depends on the horseshoe-shaped shower head 8 as an interface can directly switch shower water to the shower outlets 82 on the horseshoe-shaped shower head 8 or the first outlet 13 whose male threads engaging another type of outlet accessory, that is, the horseshoe-shaped shower head 8 can be turned between predetermined angles (FIG. 5).

The horseshoe-shaped shower head 8 which has been turned to a proper position for spray of shower water (turned to an elevation angle, e.g., 30°, from bottom to top) by one user synchronously rotates the two interlinking valves 5 until a predetermined angle so that the flexible positioning module 21 in the positioning valve 2 is positioned in the locating slot 51 (FIG. 6) and simultaneously rotates the switchable changeover valve 4 in order to develop a channel by which shower water out of the hose 16 is supplied to the horseshoe-shaped shower head 8 via discharge orifices 31 on the adapter member 3 and sprayed on a user's body from the shower outlets 82.

The horseshoe-shaped shower head 8 which has been turned to a general position for spray of shower water (turned to an elevation angle, e.g., 90° perpendicular to the ground surface, from bottom to top) synchronously rotates the two interlinking valves 5 until a predetermined angle so that the flexible positioning module 21 held in the positioning valve 2 is positioned in the locating slot 51 and simultaneously rotates the switchable changeover valve 4 in order to develop a channel by which shower water out of the hose 16 is sprayed on a user's body via the first outlet 13 on the main outlet body 1 as an alternative option for supply of shower water.

Supply of shower water via the first outlet 13 or the shower outlets 82 of the horseshoe-shaped shower head 8 is terminated when a user who intends to stop running of water from the horseshoe-shaped shower head 8 turns off a switch (not in FIGS. 5 and 6) at the hose 16 which is coupled with the inlet 12 on the main outlet body 1.

As such, the present invention which is taken as not only an interface for spray of shower water from the horseshoe-shaped shower head 8 but also a switch changing discharge of shower water simplifies necessary components, reducing manufacture costs, and linking minimized accessories for direct usage. Moreover, the present invention is in conformity with an aesthetic demand in virtue of its specific shape.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A horseshoe-shaped shower outlet assembly, comprising:

a main outlet body in which there is a space developed, comprising an inlet, a first outlet, a second outlet and a third positioning port, each of which is connected between said space and external environment;

a positioning element with one end connected to said third positioning port on said main outlet body;

an adapter member which allows one end to be coupled with said second outlet on said main outlet body and comprises a number of discharge orifices at its surface;

a valve pivoted to and held in said positioning element and said third positioning port;

two interlinking elements connected to external ends of said positioning element and said adapter member, respectively, and sealing both said second outlet and said third positioning port on said main outlet body wherein said two interlinking elements are synchronously actuated with said valve; and a horseshoe-shaped shower head which comprises a number of shower outlets and two ends thereof are coupled with said two interlinking elements, respectively, wherein when the horseshoe-shaped shower head is switchably turned within predetermined angles with respect to the first outlet, one of the two interlinking elements drives the positioning element and the valve to selectively establish a tunnel connected to the first outlet or the second outlet, and the horseshoe-shaped shower head is taken as an interface by which a user switch and control water flows.

2. The horseshoe-shaped shower outlet assembly according to claim 1 wherein said inlet on said main outlet body develops female threads used to link an external hose and an adapter thereof.

3. The horseshoe-shaped shower outlet assembly according to claim 1 wherein said first outlet on said main outlet body develops male threads used to link another external outlet accessory.

4. The horseshoe-shaped shower outlet assembly according to claim 1 wherein said positioning element is provided with a flexible positioning module at one end, and said one of the two interlinking elements outside said positioning element is designed to have a locating slot so that said flexible positioning module of said positioning element slips in and is glided and positioned by said locating slot, and wherein said flexible positioning module comprises a spring externally resisting said positioning valve and a positioning column contacting said spring so that said positioning column of said flexible positioning module slips in and is glided and positioned by said locating slot.

5. The horseshoe-shaped shower outlet assembly according to claim 1 further comprising two bolt-on members which are externally screwed into said two interlinking elements respectively and coupled with said valve and said adapter member respectively so that said two interlinking elements are situated outside said second outlet and said third positioning port on said main outlet body respectively, revolving under effect of force, and actuating said two interlinking elements to turn synchronously.

6. The horseshoe-shaped shower outlet assembly according to claim 1 further comprising two caps externally joining said two interlinking elements and concealing said bolt-on members.

7. The horseshoe-shaped shower outlet assembly according to claim 1 wherein said horseshoe-shaped shower head is provided with a horseshoe-shaped body, a horseshoe-shaped front cover and a horseshoe-shaped rear cover; said horseshoe-shaped body develops a horseshoe-shaped water channel, both ends of said horseshoe-shaped body connecting external environment, comprises a number of shower outlets at its front side, and allows its both ends to be coupled with said two interlinking elements; said horseshoe-shaped front cover which is covered on said horseshoe-shaped body's front side comprises a number of front cover outlets connected to said shower outlets; said horseshoe-shaped rear cover is mounted on said horseshoe-shaped body's back side.

* * * * *